US006654960B2

(12) United States Patent
Cho

(10) Patent No.: US 6,654,960 B2
(45) Date of Patent: Dec. 2, 2003

(54) SHIN GUARD

(75) Inventor: Man-Hee Cho, Kyungki-do (KR)

(73) Assignee: Hwi Kim, Seoul (KR)

( * ) Notice: Subject to any disclaimer, the term of this patent is extended or adjusted under 35 U.S.C. 154(b) by 0 days.

(21) Appl. No.: 10/122,574

(22) Filed: Apr. 15, 2002

(65) Prior Publication Data

US 2003/0088900 A1 May 15, 2003

(30) Foreign Application Priority Data

Nov. 14, 2001 (KR) ..... 20-2001-35014 U

(51) Int. Cl.[7] ..... A41D 13/00
(52) U.S. Cl. ..... 2/22; 602/62
(58) Field of Search ..... 2/22, 16, 23, 24, 2/44, 45, 267, 268, 455, DIG. 1, 911; 128/882, 892; 602/23, 60, 61, 62, 5–8

(56) References Cited

U.S. PATENT DOCUMENTS 4,370,754 A * 2/1983 Donzis ..... 2/463
5,301,370 A * 4/1994 Henson ..... 2/22
5,405,312 A * 4/1995 Jacobs ..... 602/5
5,840,397 A * 11/1998 Landi et al. ..... 428/73
6,093,468 A * 7/2000 Toms et al. ..... 428/67

* cited by examiner

*Primary Examiner*—Tejash Patel
(74) *Attorney, Agent, or Firm*—Ladas & Parry

(57) ABSTRACT

The present invention relates to a shin guard, and in particular to a shin guard which is well adapted irrespective of a body shape of a user based on a flexible construction and is capable of implementing a good ventilation and an easier sweat exhaust. The shin guard according to the present invention includes a plate shaped smooth synthetic resin cover in which a plurality of mesh ventilation holes are formed in the whole surfaces of the cover, said cover being curved for thereby being well stuck to a shin of a user, and a foam synthetic resin buffering plate which is attached to a back surface of the cover and includes a plurality of ventilation holes corresponding to the mesh ventilation holes formed in the cover and a plurality of protrusions in the back surface of the same for thereby implementing a good ventilation through each ventilation hole.

4 Claims, 3 Drawing Sheets

SHIN GUARD

BACKGROUND OF THE INVENTION

1. Field of the Invention

The present invention relates to a shin guard, and in particular to a shin guard which is well adapted irrespective of a body shape of a user based on a flexible construction and is capable of implementing a good ventilation and an easier sweat exhaust.

2. Description of the Background Art

Generally, a shin guard is basically directed to preventing a certain external impact when a user performs a sports activity such as a dynamic activity for thereby protecting a user's shin and a certain damage of a shin.

A conventional shin guard is formed of a hard synthetic resin cover for protecting a shin. In addition, a ventilation hole is formed only in a certain part of a shin protection member for thereby exhausting sweat therethrough and implementing a ventilation operation.

Since the above conventional shin protection member is formed of a hard synthetic resin, a cover is not flexible. Therefore, it is impossible to satisfy a desired wearing feel of each user because the user's body shapes and characteristics are different. In addition, since the cover is not flexible, the cover may damage a user's shin for thereby causing an inconvenience for using the same. Therefore, the users must buy a desired shin guard which is well adapted to a user's body shape and characteristic for thereby causing an inconvenience. Since a shin guard fabricator fabricates various type shin guards which are well adapted to the user's different body shapes and characteristics, so that a fabrication cost is increased.

In addition, a ventilation hole is formed only in a part of a shin protection member, a ventilation and sweat exhaust of a sweating shin are not easily implemented, so that a shin skin is easily damaged due to a non-exhausted sweat in a portion in which a ventilation and sweat exhaust are not implemented when a user wears a shin guard for a long time. In addition, the shin guard formed of a hard synthetic resin is heavy, a fatigue is increased when a user uses a shin guard for a long time.

SUMMARY OF THE INVENTION

Accordingly, it is an object of the present invention to provide a shin guard which overcomes the problems encountered in the conventional art.

It is another object of the present invention to provide a shin guard which is well adapted to a user irrespective of a user body shape based on a flexible smooth synthetic resin cover and is capable of implementing a good ventilation and sweat exhaust using an embossed foam material and preventing a user's fatigue based on a light weight of a shin guard.

To achieve the above objects, there is provided a shin guard which includes a plate shaped smooth synthetic resin cover in which a plurality of mesh ventilation holes are formed in the whole surfaces of the cover, said cover being curved for thereby being well stuck to a shin of a user, and a foam synthetic resin buffering plate which is attached to a back surface of the cover and includes a plurality of ventilation holes corresponding to the mesh ventilation holes formed in the cover and a plurality of protrusions in the back surface of the same for thereby implementing a good ventilation through each ventilation hole.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENTS

The construction and operation of a shin guard according to the present invention will be explained with reference to the accompanying drawings.

Figure 1:
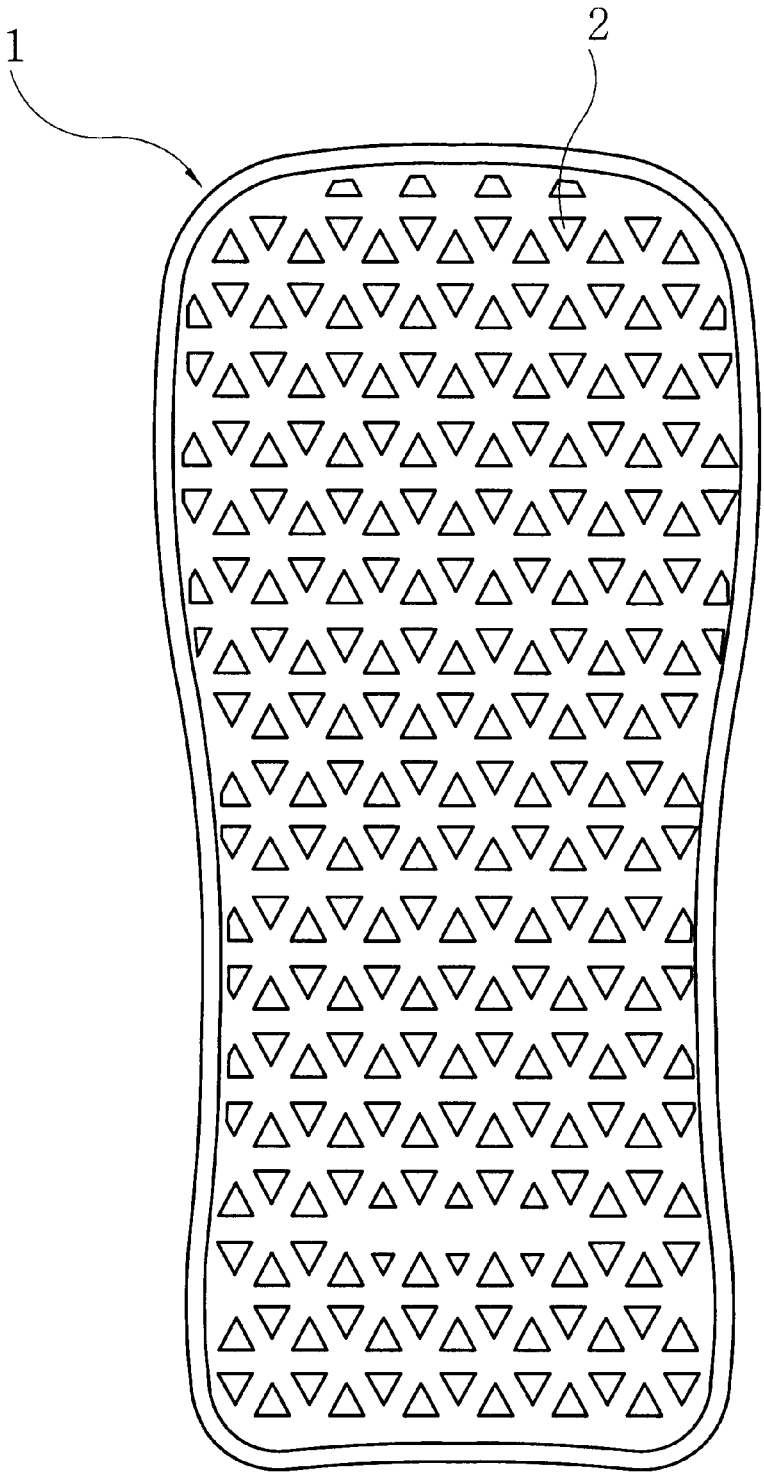
FIG. 1 is a front view illustrating a shin guard according to the present invention.
Figure 2:
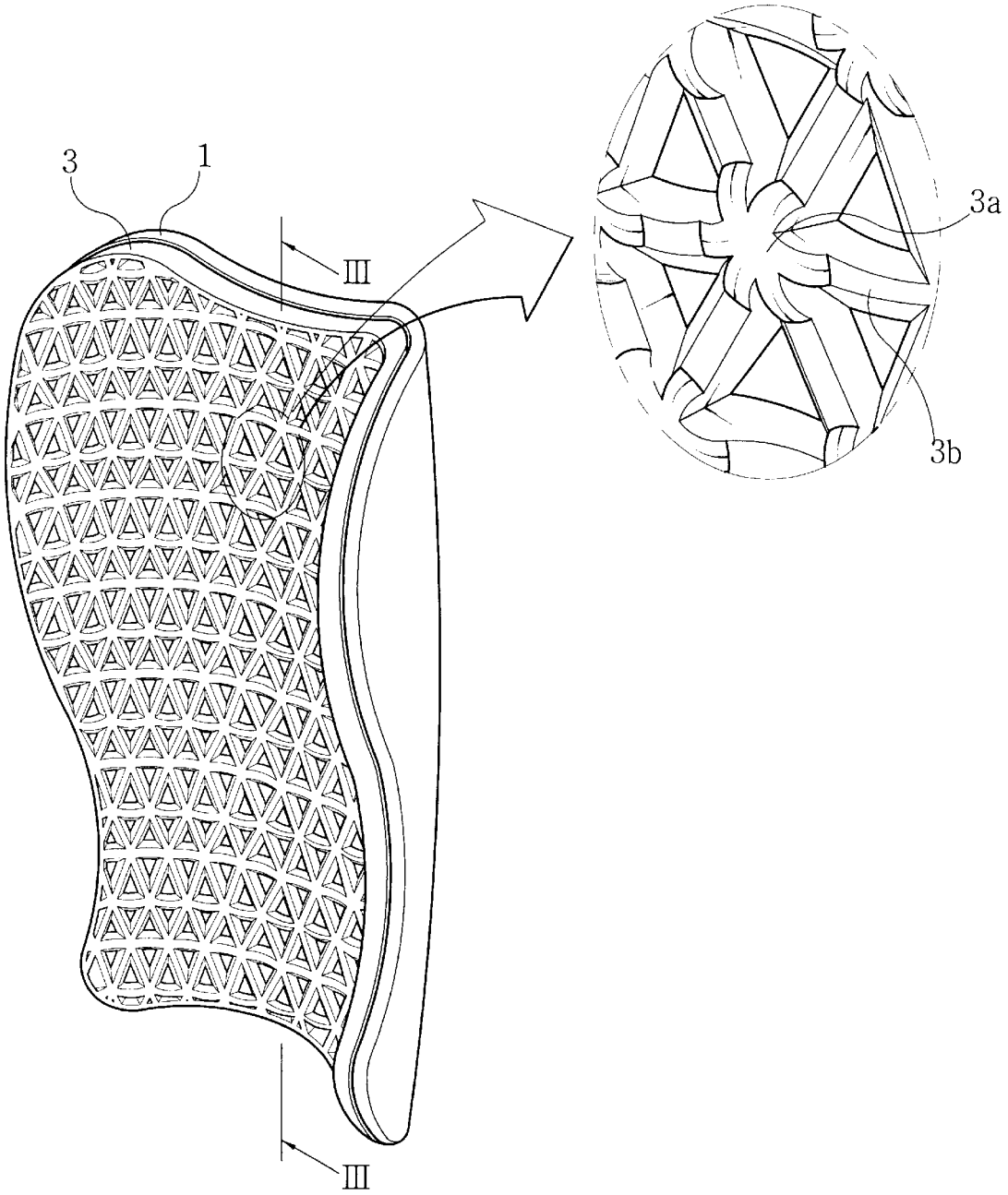
FIG. 2 is a back perspective view illustrating a shin guard according to the present invention.

As shown in FIGS. 1 and 2, a shin guard according to the present invention includes a cover 1 and a buffering plate 3.

The above cover 1 is formed in a curved plate shape for thereby being well stuck to a shin of a human body. The material of the cover 1 is a smooth synthetic resin, so that the cover 1 is flexible irrespective of a user's body shape and characteristic. A plurality of triangle mesh ventilation holes 2 are formed in the whole surfaces of the cover 1. Therefore, a user's sweat is easily exhausted through the above ventilation holes 2. In addition, since the above ventilation holes 2 are formed in the whole surfaces of the cover 1, the weight of the shin guard is decreased for thereby implementing a good wearing feel.

As shown in FIG. 2, the buffering plate 3 is formed of a foam material having a certain thickness. The above buffering plate 3 is attached to a back surface of the cover 1 for thereby effectively buffering an external impact applied thereto. A plurality of ventilation holes are formed in the buffering plate 3 in such a manner that the above ventilation holes correspond to the triangle shaped mesh ventilation holes 2 of the cover 1. A plurality of protrusions 3*a* are formed in a back surface of the buffering plate 3, namely, in a portion which directly contacts with a user's shin for thereby implementing an easier ventilation between the ventilation holes. Therefore, even when a user uses the shin guard according to the present invention for a long time, it is possible to implement an effective ventilation and sweat exhaust for thereby preventing a certain damage due to a non-exhausted sweat.

Figure 3:
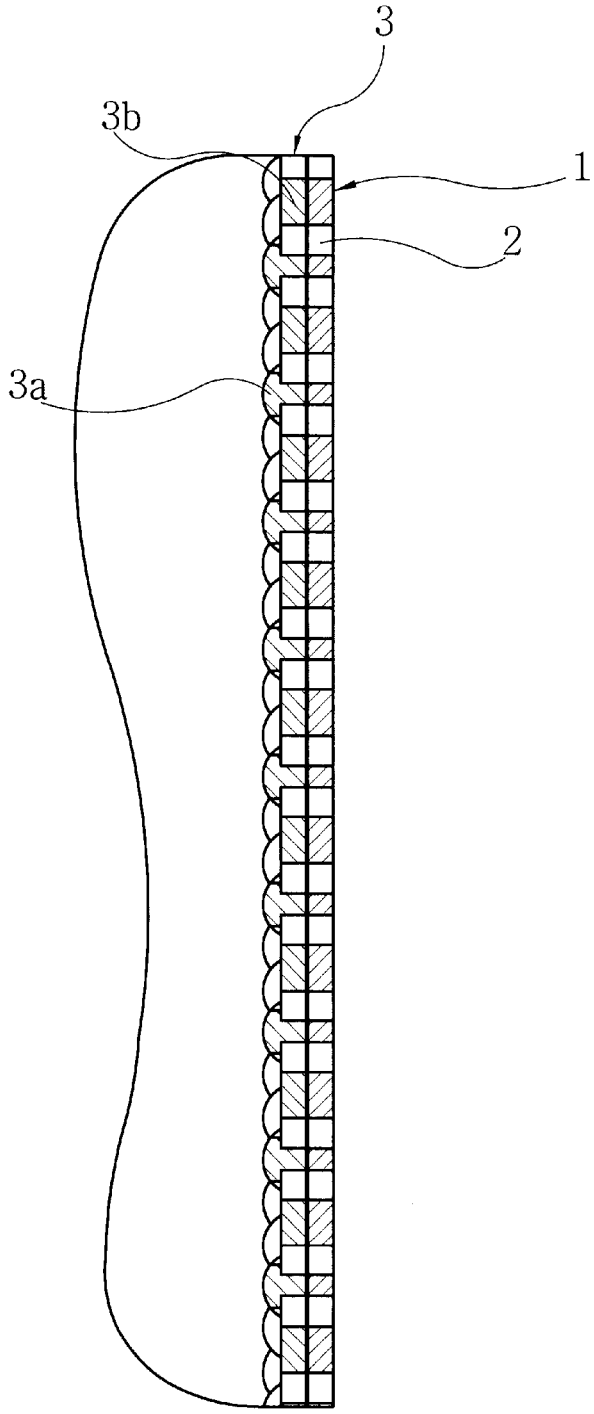
FIG. 3 is a cross-sectional view taken along line III—III of a shin guard according to the present invention.

As shown in FIG. 3, the protrusions 3*a* are protruded higher than the portions 3*b* in which the ventilation holes are formed, for thereby implementing an easier ventilation through each ventilation hole. The above protrusions 3*a* are formed in the whole back surfaces of the buffering plate 3 at a regular interval.

Accordingly, in the shin guard according to the present invention, since the shin guard is light, it is possible to decrease a fatigue of a football player who uses a shin guard for a long time. In addition, in the shin guard, since a ventilation is effectively implemented, it is possible to enhance a game performance.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. A shin guard comprising:

a cover having a front surface and a rear surface, and having a plurality of mesh ventilation holes formed therethrough, the cover being formed of a synthetic resin and being sufficiently flexible to conform to the shin of a user when worn; and a buffering plate attached to the rear surface of the cover and formed of a synthetic resin foam, said plate having formed therein an intersecting network of protrusions defining a plurality of ventilation holes, the ventilation holes being formed through said plate and corresponding to the plurality of mesh ventilation holes in the cover;

said network of protrusions being disposed to contact the shin of the user with the shin guard conforming to the shin of the user so as to space the ventilation holes away from the shin of the user, and such that said protrusions and ventilation holes provide air circulation between the shin guard and the shin of the user with the shin guard conforming to the shin of a user.

2. The shin guard of claim 1, wherein all of the ventilation holes are triangular in shape.

3. The shin guard of claim 2, wherein the ventilation holes are disposed over substantially the entire front surface of the cover.

4. The shin guard of claim 1, wherein the ventilation holes are disposed over substantially the entire front surface of the cover.

* * * * *